US005261958A

United States Patent [19]

Davies

[11] Patent Number: 5,261,958

[45] Date of Patent: Nov. 16, 1993

[54] ADHESIVE-APPLYING MACHINE

[75] Inventor: John Davies, Syston, England

[73] Assignee: British United Shoe Machinery Ltd., Leicester, England

[21] Appl. No.: 743,990

[22] Filed: Aug. 12, 1991

[30] Foreign Application Priority Data

Aug. 14, 1990 [GB] United Kingdom ..... 9017782

[51] Int. Cl.[5] ..... B05C 3/20

[52] U.S. Cl. ..... 118/696; 118/697; 118/411; 118/323; 118/315

[58] Field of Search ..... 118/696, 697, 211, 221, 118/225, 242, 256, 315, 323, 410, 411

[56] References Cited

U.S. PATENT DOCUMENTS

| | | | |
|---|---|---|---|
| 2,466,824 | 4/1949 | Prue . | |
| 3,628,500 | 12/1971 | Matlock . | |
| 4,278,044 | 7/1981 | French | 118/211 |
| 4,373,467 | 2/1983 | Becka | 118/211 |
| 4,386,576 | 6/1983 | Johnson | 118/211 |
| 4,391,011 | 7/1983 | Peck et al. | 12/1 B |
| 4,584,964 | 4/1986 | Engel | 118/696 |
| 4,605,569 | 8/1986 | Shimada et al. | 118/211 |
| 4,836,139 | 6/1989 | Davies | 118/696 |
| 4,951,338 | 8/1990 | Brown et al. | 12/77 |
| 4,959,977 | 10/1990 | Davies et al. | 69/21 |
| 4,961,965 | 10/1990 | Dietz | 118/697 |

FOREIGN PATENT DOCUMENTS

| | | | |
|---|---|---|---|
| 145096 | 2/1951 | Australia | 118/211 |
| 307506 | 3/1987 | European Pat. Off. | 118/696 |
| 351993 | 1/1990 | European Pat. Off. . | |
| 893477 | 10/1953 | Fed. Rep. of Germany . | |
| 2171222 | 8/1986 | United Kingdom | 118/696 |

*Primary Examiner*—W. Gary Jones
*Assistant Examiner*—Todd J. Burns

[57] ABSTRACT

For applying adhesive to a shoe bottom an applicator (708) is provided which comprises a plurality of fingers (732) spring-urged towards the work and end portions thereof providing an adhesive-applying surface (736) to which adhesive is supplied via tubes (738) to outlets in said end portions. The applicator is capable of rotation about an axis which passes through the adhesive-applying surface (736) and in addition, the applicator can tilt about a further axis (P) which intersects said axis of rotation at the adhesive-applying surface. Drive means is also provided for effecting relative lengthwise, heightwise and widthwise movement between a shoe support (18) and a tool holder (670) by which the applicator is supported. For controlling the flow of adhesive a valve (744) is provided which is pneumatically operated and also has a suck-back feature. Moreover, the arrangement of the adhesive supply parts (740–752) and the supply of air under pressure (772–776) is such that the applicator can be rotated through 360° or more without the need for thereafter reversing the direction of rotation, e.g. in order to unwind any flexible connections.

6 Claims, 4 Drawing Sheets

ADHESIVE-APPLYING MACHINE

BACKGROUND TO THE INVENTION

This invention is concerned with an adhesive-applying machine for applying adhesive progressively to selected portions of a workpiece surface, e.g. marginal portions of a lasted shoe bottom or of the attachment surface of a shoe sole, said machine comprising a work support for supporting a workpiece to selected portions of a surface of which adhesive is to be applied, a mounting for an adhesive applicator, and first motor means operable under programmed control for effecting relative movement between the work support and mounting, and thus between an applicator supported by the mounting and the surface of a workpiece supported by the work support, in directions extending lengthwise and widthwise of the workpiece surface whereby such applicator is caused to follow a desired path relative to the workpiece surface, and also in a direction extending heightwise of the workpiece surface thus to follow the heightwise contour thereof.

One such machine is described in U.S. Pat. No. 4,951,338, being a machine for applying adhesive progressively along marginal portions of lasted shoe bottoms (although, it will be appreciated, such a machine could readily also be used for applying adhesive to the attachment surface of a shoe sole, with the necessary modification to the work support). In this machine the adhesive applicator comprises a nozzle the outlet of which is surrounded by a brush element which is rotatable whereby to spread adhesive supplied through said nozzle over the surface of the marginal portion of the shoe bottom. Using such an applicator, it has been found that a relatively uniform coating of adhesive can be applied to the shoe bottom, and moreover the band of adhesive thus applied has a relatively clearly defined edge, which is of course necessary when applying adhesive for sole attaching, since if the adhesive extends in the finished shoe beyond the edge of the attached sole the finished shoe has an unsightly appearance, whereas if the adhesive band does not extend up to the outsole edge a risk of insecure attachment of the sole arises.

The quantity of adhesive applied progressively to a workpiece surface depends upon the rate of supply of adhesive to the applicator and also the speed at which the applicator traverses the workpiece surface. Whereas for most shoes the rotary brush system referred to above has been found to be adequate in terms of both the thickness of the applied adhesive and also the operational speed (machine cycle time), in some circumstances it has been found that in order to achieve the desired thickness of the applied layer the speed of traverse of the applicator has to be reduced to a speed which is unacceptable in terms of shoe factory output. Similarly, in some cases it has been desirable to operate the machine at a higher operational speed than is normally set, and again this increase in operational speed can be achieved only with a commensurate detrimental effect on the applied layer.

In addition, in the case of shoes with seams, it has sometimes been found that, because of the characteristics of adhesive flow using the rotary brush system, dry spots may occur immediately "downstream" of a seam, again with detrimental effects in terms of the secureness of the adhesive bond.

OBJECT OF THE INVENTION

It is thus the object of the present invention to provide an improved adhesive-applying machine for applying adhesive progressively to selected portions, of a workpiece surface, which machine mitigates or indeed overcomes the problems referred to above.

SUMMARY OF THE INVENTION

The invention thus provides an adhesive-applying machine for applying adhesive progressively to selected portions of a workpiece surface, e.g. marginal portions of a lasted shoe bottom or of the attachment surface of a shoe sole, said machine comprising a work support for supporting a workpiece to selected portions of a surface of which adhesive is to be applied, a mounting for an adhesive applicator, first motor means operable under programmed control for effecting relative movement between the work support and mounting, and thus between an applicator supported by the mounting and the surface of a workpiece supported by the work support, in directions extending lengthwise and widthwise of the workpiece surface whereby such applicator is caused to follow a desired path relative to the workpiece surface, and also in a direction extending heightwise of the workpiece surface thus to follow the heightwise contour thereto, wherein the applicator has an adhesive-applying surface which is so configured as to make a line contact, or substantially so, with the workpiece surface, and the applicator is supported in its mounting for rotation about an axis extending heightwise of the workpiece surface and passing through the adhesive-applying surface, second motor means being provided, also operable under programmed control, for effecting rotation of the applicator about said axis whereby to maintain the adhesive-applying surface in an orientation such that the line contact it makes with the workpiece surface extends transversely of said desired path of relative movement between the applicator and the workpiece surface, as such relative movement is progressively effected.

By reason of the provision of an applicator having an adhesive-applying surface which makes a line contact with the workpiece surface and by controlling the orientation of that surface in relation to the shoe bottom, a greater flow of adhesive can be accommodated while retaining the capability of controlling the thickness of the applied band (or layer) of adhesive so that either for the same speed of traverse a greater thickness of applied layer can be achieved or for a faster speed of traverse the same thickness of applied layer can be achieved as with a rotating brush, or indeed both the speed of traverse can be enhanced and a thicker coating of adhesive be achieved, while nevertheless retaining the control of the definition of the edge of the applied band of adhesive at least as closely as when using the rotary brush system of the earlier machine.

For enhancing the performance of the machine in accordance with the present invention, preferably there is further provided third motor means, also operable under programmed control, for effecting relative tilting movement between the work support and the mounting about an axis extending transversely of said desired path of relative movement therebetween, which axis intersects at the adhesive-applying surface of the applicator with the axis about which the applicator rotates whereby said latter axis is maintained perpendicular, or substantially so, to the workpiece surface in accordance with the heightwise contour of said surface in a plane extending along said desired path as relative movement takes place along said path. In addition, preferably in said machine the adhesive-applying surface accommodates itself to the contour of the workpiece surface in a direction extending transversely of said desired path of relative movement, as the applicator follows said path. In this way variations in such transverse contour of the workpiece surface can also be accommodated, thus also enabling the orientation of the adhesive-applying surface to be accurately controlled.

In a preferred embodiment, moreover, the applicator comprises a plurality of spring-urged fingers end portions of which together constitute the adhesive-applying surface of the applicator, the arrangement being such that the second motor means is operable to cause the adhesive-applying surface to be oriented in a trailing condition in relation to the fingers as relative movement is effected between the work support and the mounting Using such an applicator, the problem of "dry spots", which is sometimes met using a rotating brush assembly, is overcome. By arranging the fingers in such a manner that the adhesive-applying surface provided at the end portions thereof "trail", especially when also the position of the adhesive-applying surface is closely maintained both by retaining the fingers in alignment, or substantially so, with the direction of traverse and also by locating the adhesive-applying surface such that the axis of rotation of the applicator and also the axis about which the applicator tilts intersect at the adhesive-applying surface, significant improvements can be achieved over the earlier machine in the particular circumstances referred to above.

In order to facilitate the rotation of the applicator conveniently the mounting comprises a cylindrical member within which a support for the adhesive applicator is accommodated for rotation therein about said axis of rotation, said support being operatively connected to the motor means for effecting rotational movement of the support and thus of the applicator as aforesaid. Moreover, for supplying adhesive to the adhesive-applying surface preferably the support has formed therein a through-bore which is supply of adhesive under pressure, and at the other end with one or more supply lines to outlet ports formed one in the end portion of each of the fingers, there being located between the through-bore and the end portion of the fingers, for controlling the flow of adhesive to said end portions, a valve which is opened and closed by pneumatically operated means to which air under pressure is supplied via a port in the mounting operatively connected, through an annular groove connection, with a bore in the support for the applicator. More particularly, the support conveniently carries at its lower end projecting from the mounting a plate member on which the applicator is mounted, the valve being accommodated within the plate member and the pneumatically operated means being supported thereby. In this way, it will be appreciated, the support together with the plate member and all the elements supported on it can be rotated in the mounting through 360 degrees without the need for thereafter reversing the direction of rotation e.g. to unwind adhesive supply tubing or pneumatic tubing, which is often the case with applicators of similar construction.

The valve of the applicator in accordance with the invention preferably comprises a ball valve arrangement including a ball movable into a sealing position in which it prevents the flow of adhesive therepast, plunger means being provided, operable in a chamber "downstream" of the ball, whereby the ball can be dislodged from such sealing position, the arrangement being such that continued retracting movement of the plunger means after the ball has moved back to its sealing position is effective to draw adhesive back into the chamber from the supply line(s) to the end portion of each of the fingers; preferably, furthermore, the plunger means is operated by said pneumatically operated means referred to above, while the ball is spring-urged into its sealing position. By such a ball valve arrangement, it will be appreciated, a so-called "suck-back" capability is provided within the adhesive supply system, with a result that on the one hand drooling of adhesive when the machine is at rest can be avoided, while at the same time a quantity of adhesive is "stored" in the chamber for immediate supply at the start of a cycle of operation of the machine; in this way a so-called "dry start" can be avoided. This is especially advantageous where the adhesive flow is temporarily arrested during the machine cycle.

In order to achieve the "trailing" position of the adhesive-applying surface of the applicator in relation to the fingers, furthermore, conveniently the applicator is mounted on the plate member at a position offset from the axis of rotation provided by the mounting such that the fingers extend radially from said axis.

BRIEF DESCRIPTION OF THE DRAWINGS

There now follows a detailed description, to be read with reference to the accompanying drawings, of one machine in accordance with the invention. It will of course be appreciated that this machine has been selected for description merely by way of exemplification of the invention and not by way of limitation thereof.

In the accompanying drawings.

DESCRIPTION OF THE PREFERRED EMBODIMENT

Figure 1:
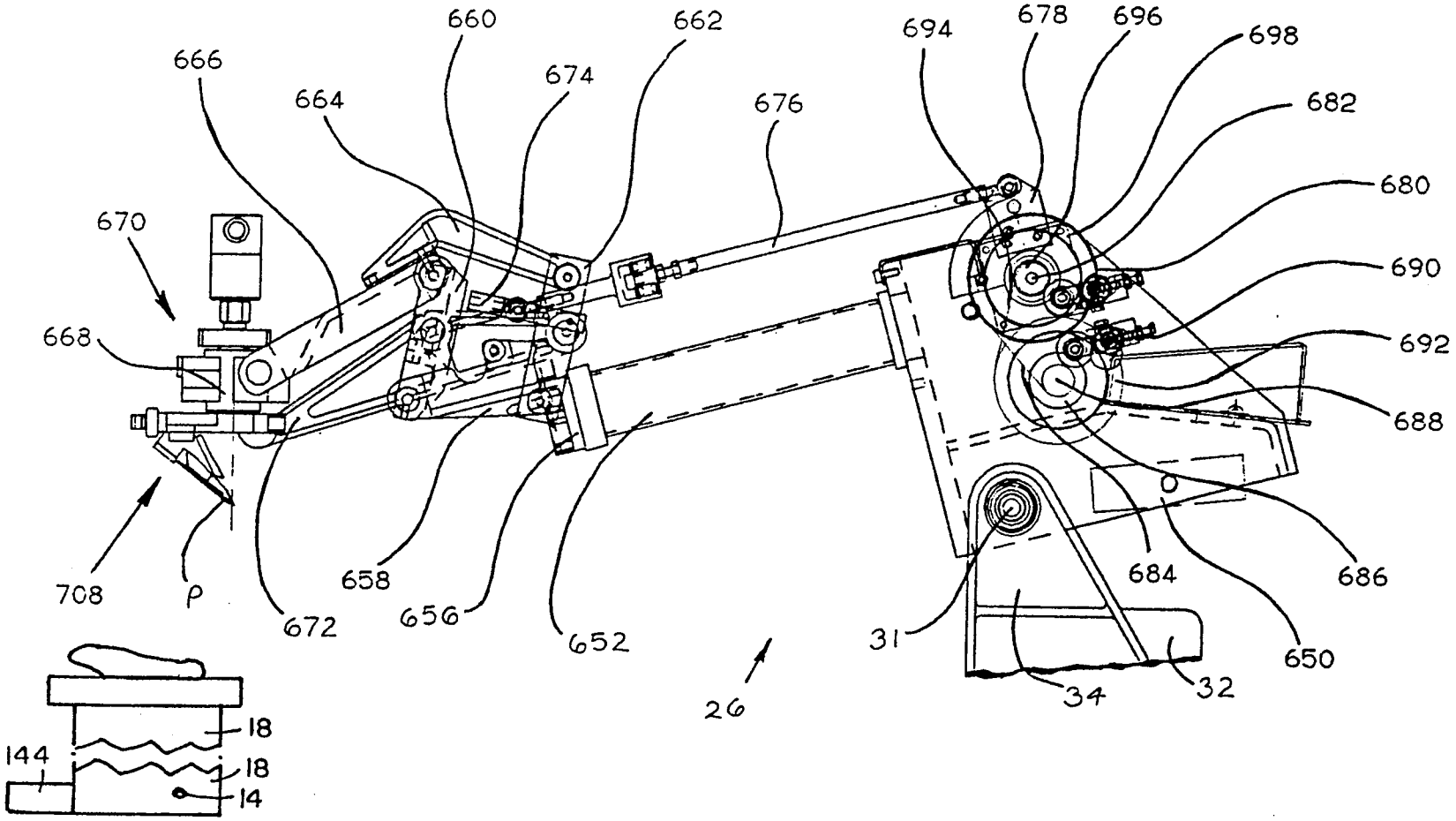
FIG. 1 is a view in side elevation of a tool support arrangement of the machine in accordance with the invention.

The machine now to be described is generally similar, except as hereinafter described, to the machine described in U.S. Pat. No. 4,951,338 which is itself a modification of the apparatus described in U.S. Pat. No. 4,391,011, modified as described in U.S. Pat. No. 4,959,977, this latter machine (apparatus) however being for use in performing a roughing operation progressively along marginal portions of a shoe bottom as opposed to applying adhesive progressively along such marginal portions. Reliance is thus placed upon the disclosure of the aforementioned specifications and in particular, where like parts are incorporated in the present machine but not shown in the accompanying drawings, the reference numerals from the earlier specification are used, but are placed in brackets to indicate that the parts are not shown in the accompanying drawings.

The machine now to be described thus comprises a base (10) supporting, by a bracket (12), a pivot shaft 14 about which a support (16) for a work support (or shoe support) 18 can pivot. The shoe support is arranged to support a shoe (S) bottom uppermost, with the toe end thereof facing towards the front of the machine, i.e. towards the operator. At its rear, the base (10) supports a support column structure (22) carrying a casting (24) on which is supported, for pivotal movement about a vertical axis, a support casting 34 having two upstanding lugs 32 between which tool supporting means generally designated 26 is supported for pivotal movement about a horizontal axis 31.

The machine further comprises a stepping motor 144 mounted on the base (10) and effective to cause pivotal movement of the shoe support 18 to take place about the horizontal axis provided by the shaft 14 (X-axis movement). Similarly, another stepping motor (84) is provided, carried by the casting (24) and effective to cause pivotal movement of the support casting 34 about its vertical axis (Y-axis movement). In addition, a further stepping motor (122 —described in U.S. Pat. No. 4,391,011) is supported by the support casting 34, rearwardly of its vertical pivot, to cause it, and thus the tool supporting means 26 supported thereby, to pivot about its horizontal axis 31 (Z-axis movement). It will be appreciated that the X-, Y- and Z-axes represent three coordinate axes along which a tool supported by the tool supporting means 26 can be moved along a desired path relative to the shoe support in directions extending lengthwise and widthwise of the bottom of a shoe supported by the shoe support whereby to enable such tool to follow a desired path according to the plan contour of the shoe bottom, and also in a direction heightwise of such shoe bottom, thus to follow the heightwise contour thereof (and the motors 144, (82), (122) constituting first motor means of the machine in accordance with the invention).

Further details of the construction by which movement along the three axes can take place can be found in U.S. Pat. No. 4,959,977.

The tool supporting means 26 of the machine in accordance with the invention comprises a housing 650 mounted for pivotal movement about said horizontal axis 31. From a forward face of the housing projects a hollow arm 652 at a forward end of which is mounted a plate 656 supporting two forwardly projecting arms 658, which are spaced apart widthwise of the machine and on each of which is mounted, for pivotal movement, a pair of links 660, 662, upper ends of which pivotally support a plate 664. The links 660, 662, together with the plate 664 and arms 658, thus comprise a first parallel linkage arrangement of the tool supporting means.

Fixedly secured to a forward end of the plate 664, and projecting forwardly therefrom, is a further plate 666, in a forward, bifurcated, end of which is pivotally mounted a block 668 forming part of a tool holder generally designated 670. Also secured to the tool holder, at the left-hand side thereof, is a further link 672 which is in turn pivotally connected to each of the left-hand links 660, 662. The links 660, 662, tool holder 670, link 672 and plates 664, 666 thus constitute a second parallel linkage of the tool supporting means. The various pivots are so arranged in relation to one another that the tool holder is caused to pivot about an axis (a virtual centre) which extends transversely of said desired path of relative movement between a tool and shoe bottom and which passes through a point P which represents a height datum of the machine in a desired relationship with which the bottom of a shoe supported by the shoe support (18) can be positioned by means of a holddown member (450) and toe support means (470) of said support.

For effecting such pivotal, or tilting, movement of the tool holder 670 about the transverse axis, the links 662 carry therebetween a block 674 to which is pivotally connected a forward end of a push-rod 676, the rearward end of which is similarly pivotally connected to a block 678 which is mounted on a pulley 680 freely rotatable about a drive shaft 682. The pulley 680 is caused to rotate about said shaft by a timing belt 684 entrained around a second pulley 688, a tensioning pulley 690 being provided for maintaining the tension in the belt. Mounted concentrically with the second pulley 688 is a third pulley 682 around which is entrained a second timing belt 694 meshing with a fourth, drive, pulley 696 secured on the drive shaft 682. The shaft 682 is driven by a stepping motor 698 (constituting third motor means of the machine in accordance with the invention).

Figure 2:
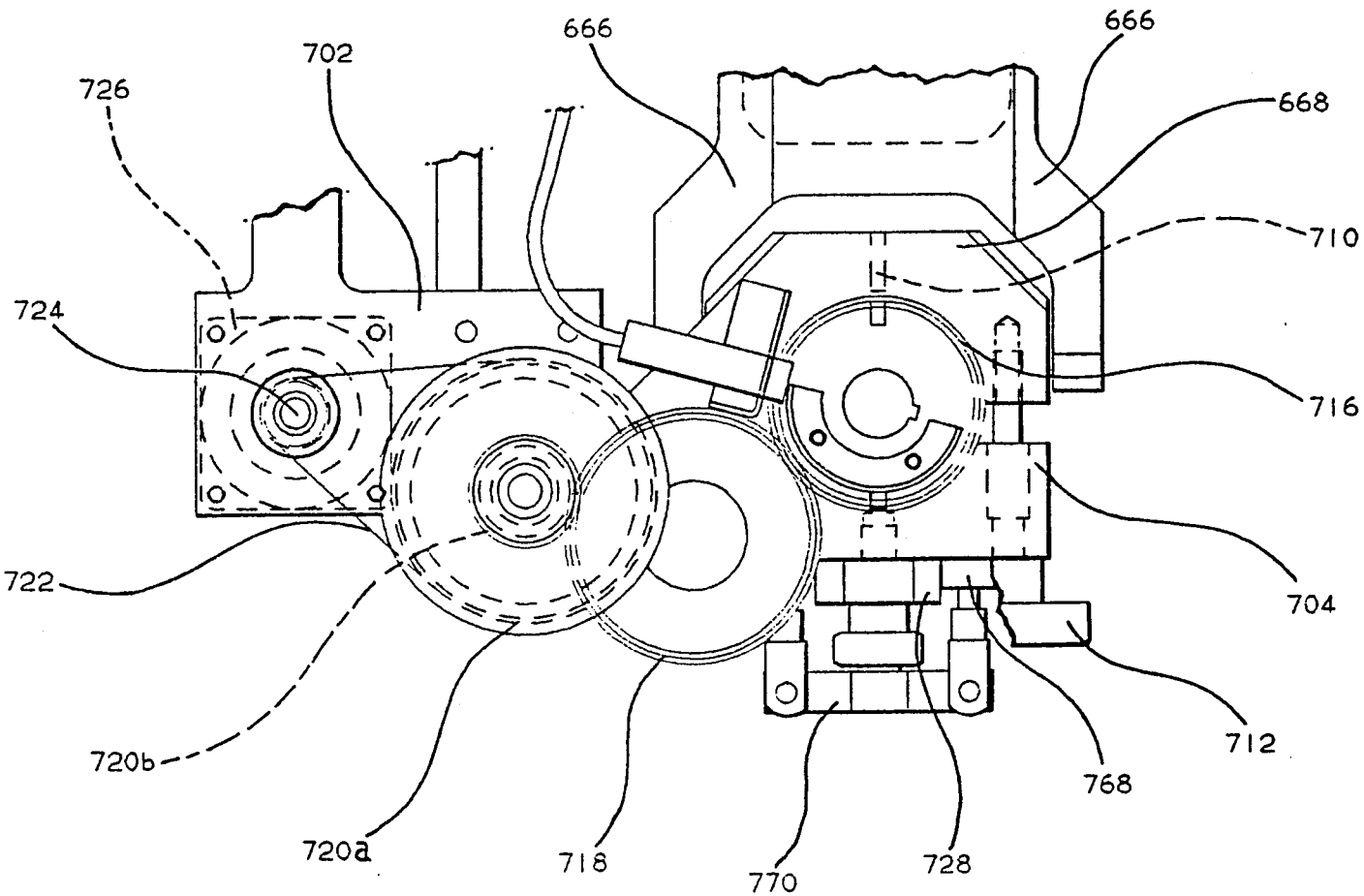
FIG. 2 is a fragmentary plan view of a drive arrangement for an adhesive applicator supported by said tool support arrangement.
Figure 3:
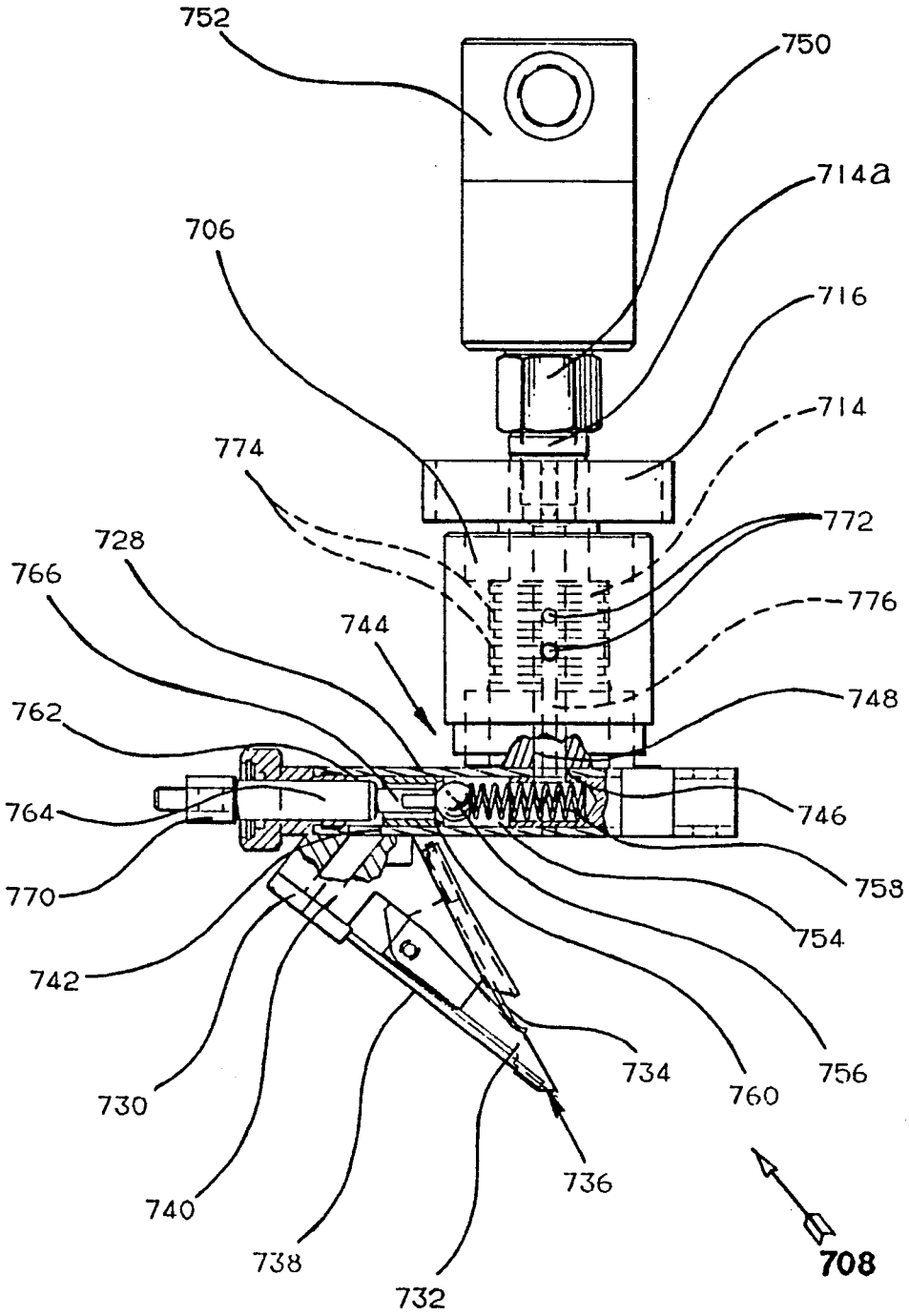
FIG. 3 is a fragmentary side view, partly in section, showing details of a ball valve arrangement and other details of the support for the adhesive applicator.
Figure 4:
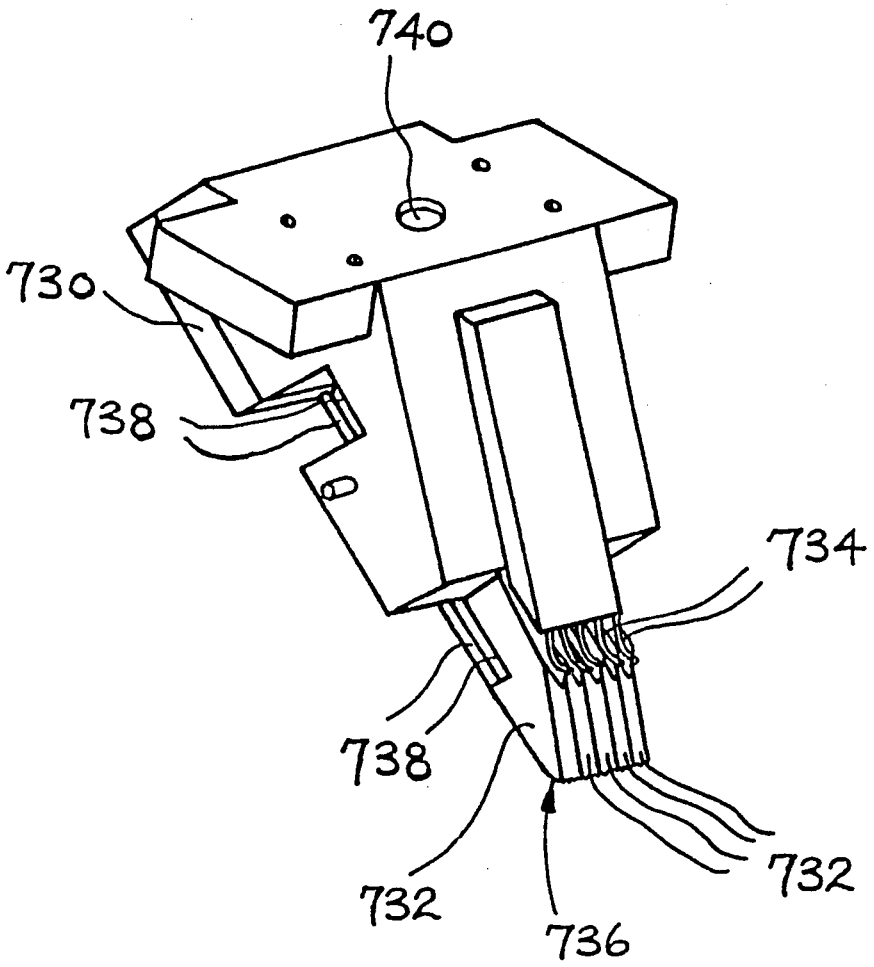
FIG. 4 is a perspective view showing details of the applicator.

The block 668 forming part of the tool holder 670 has a semi-cylindrical recess (see FIG. 2) and supports, on an extension 702, for pivotal movement thereon, a clamp member 704 also having a semi-cylindrical recess, the two recesses thus being capable of receiving therebetween a cylindrical mounting 706 for an adhesive applicator generally designated 708 (see FIG. 3). The mounting 706 has an aperture formed therein which is engaged on a spigot 710 projecting from the recess of the block 668, thus to locate the mounting accurately in position. A manually releasable clamp bolt 712 secures the mounting in clamped position.

Within the mounting 706, held captive against longitudinal movement therein, is a support 714 (FIG. 3) which can rotate, within the mounting, about an axis which thus extends heightwise of the shoe bottom. On an extension 714*a* of the support 714, projecting from the upper end of the mounting 706, is a gear 716 which is operatively connected through an idler gear 718 (FIG. 2) to a driven gear 720*a* which is in turn mounted for rotation with a further gear 720*b* itself driven via a timing belt 722 from the output drive 724 of a stepping motor 726 itself mounted on the extension 702 to the block 668. The stepping motor 726 (which constitutes second motor means of the machine in accordance with the invention) is operable to effect rotation of the support 714, and thus of the adhesive applicator 708, as will now be described.

Mounted at the lower end of the support 714 and projecting below the mounting 706, is a plate member 728 to which is secured, at a position off-set from the axis (FIG. 3) of rotation, an angled block 730 on which, extending towards the axis of rotation, are arranged a plurality of (preferably either five or seven) fingers 732, said fingers 732 being pivotally mounted on said block. Also mounted on the block, one for each finger, is plurality of springs 734 which engage the fingers and urge them to a position as shown in the drawings, while allowing the fingers to yield upwardly against the influence of the springs individually. The fingers and their mounting are so arranged that the end portions of the fingers constitutes an adhesive-applying surface generally designated 736 which lies on the axis of rotation provided by the mounting 706. Furthermore, the axis about which tilting movement of the tool holder takes place intersects the axis of rotation provided by the mounting 706, at the point P as shown in FIG. 2. In this way the applicator 708 can be held with its axis of rotation perpendicularly, or substantially so, to the bottom in accordance with the heightwise contour of the latter.

The adhesive-applying surface 736, it will be appreciated, is elongated and makes a line contact, or substantially so, with the shoe bottom. By rotating the applicator about its axis, furthermore, the surface 736 can be maintained in an orientation extending transversely of the path of the applicator along marginal portions of the shoe bottom.

For supplying adhesive to the adhesive-applying surface 736, a plurality of adhesive supply tubes 738 is provided, one associated with each finger 732, and each extending between an outlet port in the end portion of its associated finger and the block 730, within which is machined an adhesive passage 740 connecting at one end with the tubes and at the other to an outlet port 742 of a valve generally designated 744 accommodated within the plate member 728. The valve also has an input port 746 which is connected to a through-bore 748 formed in the support 714 and extends longitudinally centrally therethrough. Screw-threaded into the upper end of the extension 714*a* to the support 714 is a connection 750 by which the through-bore 748 is connected, via a so-called rotary coupling generally designated 752, to a supply of adhesive under pressure. The rotary coupling is of a type which does not rotate with the shaft on which it is supported if held under only slight pressure, e.g. the pressure applied by a flexible adhesive supply pipe (not shown). One such rotary coupling is available commercially from Deublin Limited.

The valve 744 is of the ball valve type and comprises a first chamber 754 into which the inlet port 746 open, said first chamber accommodating a ball 756 which is urged by a spring 758 into a sealing position with a seating 760. The seating 760 is constituted by a sleeve having a through-passage to a second chamber 762 into which the outlet port 742 opens. Accommodated within the second chamber 762 is a plunger 764 movable along the second chamber and having a projection 766 which extends through the through-passage provided by the sleeve so that the plunger can engage the ball 756 in order to unseat it from its seating 760 thus to allow the passage of adhesive through the valve, retraction of the plunger then allowing the ball to re-seat under the influence of the spring 758.

The travel of the plunger 764 in the second chamber 762 is greater than required merely to unseat the ball as aforesaid; more particularly, a movement of some 2 mm serves to unseat the ball while the overall distance through which the plunger moves is rather more in the order of 8 mm. Such movement of the plunger, which is relatively large in terms of the internal diameter of the second chamber, thus serves to vary significantly the volume of the chamber and in this way, after the ball has been re-seated, continued movement of the plunger is effective to suck back adhesive from the tubes 738 along the passage 740, thereby to reduce any risk of "drooling" of adhesive while the machine is at rest. Similarly, upon the start of the next adhesive-applying operation the initial movement of the plunger serves to expel the adhesive from the second chamber through the passage 740 and tubes 738 before the ball is unseated, so that the system is effectively primed prior to the unseating of the ball with a result that "dry starts" can be avoided.

For operating the valve, i.e. for moving the plunger 764 to-and-fro to open and close the valve, two pneumatic piston-and-cylinder arrangements 768 (one only seen in FIG. 2) are provided, mounted on the plate member 728. The two arrangements 768 operate in parallel with one another and thus are connected to opposite ends of a cross-head 770 which at its centre has connected to it a rearwardly projecting end portion of the plunger 764.

For admitting air under pressure to the piston-and-cylinder arrangements 768 air is supplied through two ports 772 in the mounting 706, said ports being aligned each with an annular groove 774 formed on the surface of the support 714. Each groove 774 is connected via a radial passage with a lengthwise extending passage 776 in the support 714, each such passage 776 in turn being connected, through connecting passages in the plate member 28, one to one end of each of the piston-and-cylinder arrangements 768, and the other to the other end of each of said arrangements 768. Thus, by switching the air supply from one of the ports 772 to the other, the piston-and-cylinder arrangements 768 are also switched, and the valve is thus opened or closed accordingly.

Because the connections between the passages 776 and the piston-and-cylinder arrangements 768 remain in the same relationship as the plate member rotates, no problems thereby arise when the plate member is rotated through 360° or more; similarly, because of the manner in which the adhesive is supplied to the valve 744 in the plate member, again no problem arises from the rotation of the plate member, and thus of the applicator. In this way, there is no necessity, after having rotated the head in one direction through 360° or more, then to rotate it back in order to avoid excessive winding of any flexible pneumatic or adhesive supply connections.

In using the machine in accordance with the invention the first motor means ((144), (82), (122)) and the third motor means 698 are operated under programmed control, as described in greater detail in the aforementioned patent specifications. In addition the second motor means 726 is also similarly operated. More particularly as the applicator 708 is caused to follow a desired path along marginal portions of the shoe bottom under the action of the first motor means, firstly it is also rotated about its axis of rotation by the motor 726 whereby to ensure that the line contact made by the adhesive-applying surface 736, provided by the end portions of the fingers 732, with the shoe bottom is maintained in an orientation such that the fingers 732 are in a trailing condition in relation to said axis and also the surface 736 extends transversely of the path followed by the applicator under the action of the first motor means, and at the same time the applicator is caused by the motor 698 to tilt in order to maintain its axis of rotation perpendicular, or substantially so, to the shoe bottom as the applicator follows its path. By using the fingers 732, moreover, the adhesive-applying surface accommodates itself readily to the transverse (or lateral) contour of the shoe bottom marginal portion; in other machines in accordance with the invention and utilising an alternative applicator having an integral adhesive-applying surface, it may instead be desirable to effect a second tilting action of the applicator about an axis extending lengthwise of the shoe bottom, a mechanism for effecting such action also being described in U.S. Pat. No. 4,951,338 (but being omitted from the present machine utilising individual spring-urged fingers for providing the adhesive-applying surface).

I claim:

1. Adhesive-applying machine for applying adhesive progressively to selected portions of a workpiece surface, said machine comprising a work support for supporting the workpiece, an adhesive applicator having a plurality of spring-urged fingers, the end portions of which fingers constitute an adhesive-applying surface which is so configured as to make a line contact, or substantially so, with the surface of the workpiece, an applicator support which is rotatable in a supporting mounting about an axis of rotation extending heightwise of the workpiece surface, upon which support the applicator is mounted at a position off-set from the axis of rotation, the fingers extending from the position of mounting such that the adhesive-applying surface lies on the axis of rotation, first motor means operable under programmed control for effecting relative movement between the work support and the mounting, and thus between the applicator and the workpiece surface, in directions extending lengthwise and widthwise of the workpiece surface, whereby the applicator is caused to follow a desired path relative to the workpiece surface, and in a direction extending heightwise of the workpiece surface thus to follow a heightwise contour thereof, and second motor means, also operable under programmed control, for effecting rotation of the applicator about the axis of rotation, whereby to maintain the adhesive-applying surface in an orientation such that the line contact it makes with the workpiece surface extends transversely of said desired path of relative movement between the applicator and the workpiece surface, as such relative movement is progressively effected.

2. Machine according to claim 1 wherein the adhesive-applying surface accommodates itself to the contour of the workpiece surface in a direction extending transversely of said desired path.

3. Machine according to claim 1 further characterised by third motor means, also operable under programmed control, for effecting relative tilting movement between the work support and the mounting about an axis extending transversely of said desired path of relative movement therebetween, which axis intersects the axis of rotation at the adhesive-applying surface of the applicator, whereby aid latter axis is maintained perpendicular, or substantially so, to the workpiece surface in accordance with the heightwise contour of said surface in a plane extending along said desired path as relative movement takes place along said path.

4. Machine according to claim 1 wherein the mounting comprises a cylindrical member within which the adhesive applicator support is accommodated for rotation therein, wherein the support has formed therein a through-bore which is connected at one end, through a rotary coupling, with a supply of adhesive under pressure and at the other end with one or more outlet ports formed in the adhesive-applying surface.

5. Machine according to claim 4 comprising a valve located between the through-bore and the adhesive-applying surface for controlling the flow of adhesive to said surface, said valve being opened and closed by pneumatically operated means to which air under pressure is supplied via a port in the mounting operatively connected, through an annular groove connection, with a bore in the support for the applicator.

6. Machine according to claim 1 wherein the adhesive applicator support carries at its lower end projecting from the mounting a plate member on which the applicator is mounted.

* * * * *